US006772614B1

(12) United States Patent
Cheng

(10) Patent No.: US 6,772,614 B1
(45) Date of Patent: Aug. 10, 2004

(54) KEY RING WITH A DIAMOND-SHINING ORNAMENTAL BLOCK

(76) Inventor: Chen-An Cheng, No. 33, Lane 340, Section 1, Hai An Road, Tainan (TW)

( * ) Notice: Subject to any disclaimer, the term of this patent is extended or adjusted under 35 U.S.C. 154(b) by 0 days.

(21) Appl. No.: 10/373,749

(22) Filed: Feb. 27, 2003

(51) Int. Cl.[7] ..... A44B 15/00

(52) U.S. Cl. ..... 70/456 R; 40/583; 40/634; 63/1.11; 63/34; 70/460; D3/207

(58) Field of Search ..... 70/456 R, 460; D3/207, 210; 40/582, 583, 634; 63/1.11, 1.1, 34; 206/37.1, 38.1

(56) References Cited

U.S. PATENT DOCUMENTS 1,966,550 A * 7/1934 Handy ..... 250/465.1
2,192,557 A * 3/1940 Netz ..... 359/543
2,201,127 A * 5/1940 Schechter ..... 250/465.1
D242,607 S * 12/1976 Covey ..... D10/72
4,209,558 A * 6/1980 Fayal ..... 70/456 R X
4,282,733 A * 8/1981 Schmitt (Johnston) .... 70/456 R
4,306,433 A * 12/1981 Kelly ..... 70/456 R
4,465,279 A * 8/1984 Larson ..... 273/146
4,576,839 A * 3/1986 Parren ..... 70/456 R X
4,684,135 A * 8/1987 Bouchal ..... 273/269
5,691,025 A * 11/1997 Hardin ..... 70/456 R X
D405,603 S * 2/1999 Tenny ..... D3/210
5,884,513 A * 3/1999 Norris ..... 70/456 R
5,934,123 A * 8/1999 Eldredge ..... 70/456 R

* cited by examiner

*Primary Examiner*—Lloyd A. Gall
(74) *Attorney, Agent, or Firm*—Rosenberg, Klein & Lee

(57) ABSTRACT

A key ring in the present invention includes an ornamental block and a buckle ring. The one-piece ornamental block is made of plastic material and may be any kind of configuration. A plurality of spaced cavities are disposed in the at least one surface of the ornamental block. The inner surface of each cavity is treated by vacuum gilding so as for the ornamental block to achieve diamond-shining effect. A through hole is provided in one end of the ornamental block for the buckle ring to penetrate through.

3 Claims, 4 Drawing Sheets

KEY RING WITH A DIAMOND-SHINING ORNAMENTAL BLOCK

BACKGROUND OF THE INVENTION

1. Field of the Invention

This invention relates to a key ring with innovatory features, and more particularly to a key ring with an ornamental block of various configurations. A plurality of spaced cavities are disposed in at least one side of the ornamental block, and an inner surface about each cavity will produce diamond-shining, or sparkling reflective, effect after being treated by vacuum gilding for forming a gilded surface portion therefor.

2. Description of the Related Art

Key rings are indispensable for modern people in daily life, and key rings provided with ornamental blocks of various styles and configurations are sold in market for the choices of different consumers. Among various styles of ornamental blocks, the ones with shining effect are most popular with young consumers. However, the cost of conventional ornamental blocks with shining effect are very high, and the processing takes time and labor.

SUMMARY OF THE INVENTION

Therefore, the objective of the present invention is to provide a key ring with a diamond-shining ornamental block that can substantially obviate the drawbacks of the related conventional ornamental blocks.

An objective of the present invention is to provide a key ring that is provided with a diamond-shining ornamental block.

Another objective of the present invention is to provide a key ring with an ornamental block, which is provided with a plurality of spaced cavities in the at least one surface of the ornamental block, and the inner surface of each cavity will produce diamond-shining effect after being treated by vacuum gilding.

Yet another objective of the present invention is to provide a key ring with a diamond-shining ornamental block that can save cost of material and time and labor for assembly.

Accordingly, a key ring in the present invention includes an ornamental block and a buckle ring. The one-piece ornamental block is made of plastic material and may be any kind of configuration. A plurality of spaced cavities are disposed in the at least one surface of the ornamental block. The inner surface of each cavity is treated by vacuum gilding so as for the ornamental block to achieve diamond-shining effect. A through hole is provided in one end of the ornamental block for the buckle ring to penetrate through.

BRIEF DESCRIPTION OF THE DRAWINGS

Other features and advantages of the present invention will become apparent in the following detailed description of the preferred embodiments with reference to the accompanying drawings, in which.

DETAILED DESCRIPTION OF THE PREFERRED EMBODIMENTS

Figure 1:
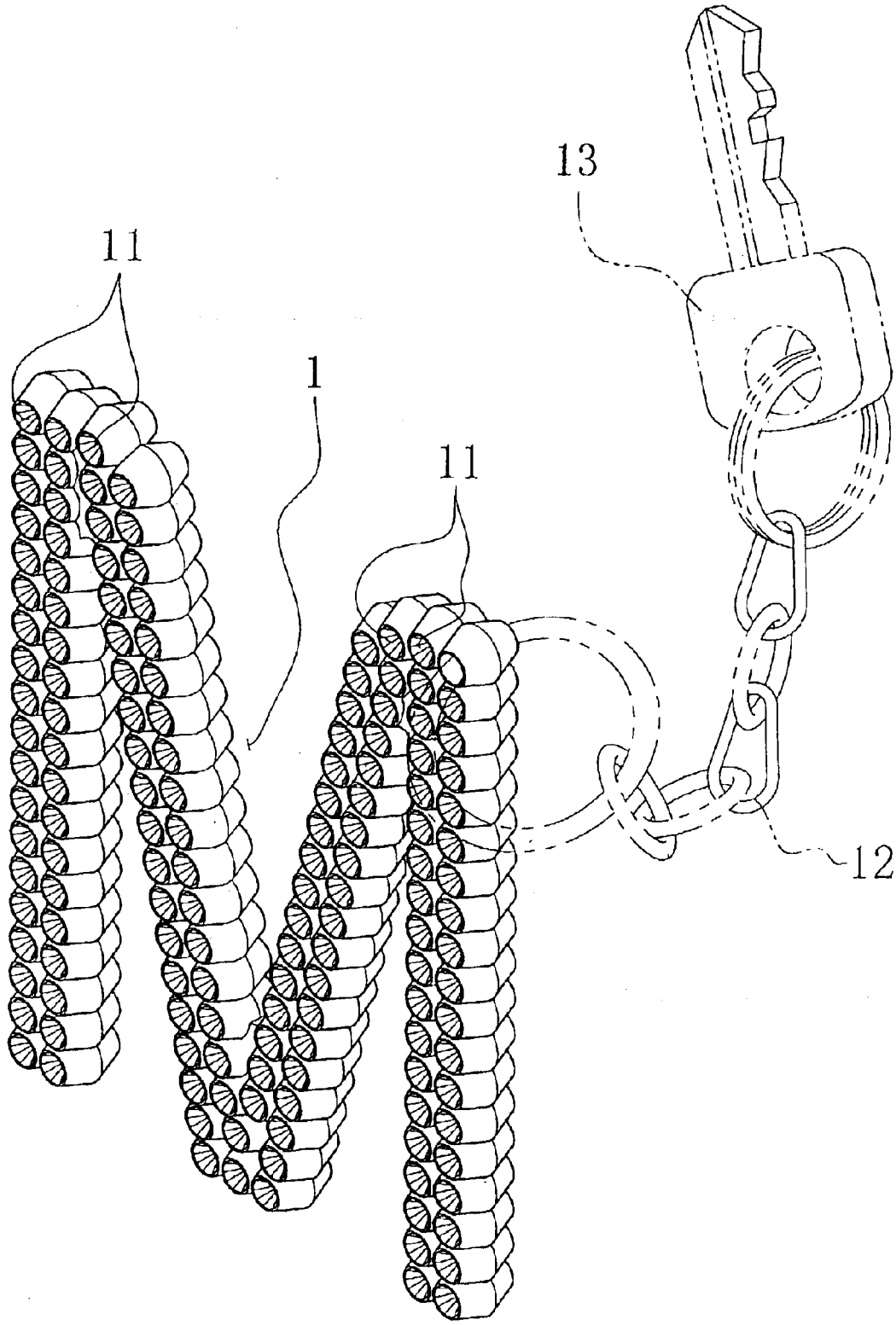
FIG. 1 is a perspective view of the key ring with an embodiment of the ornamental block in accordance with the present invention.
Figure 2:
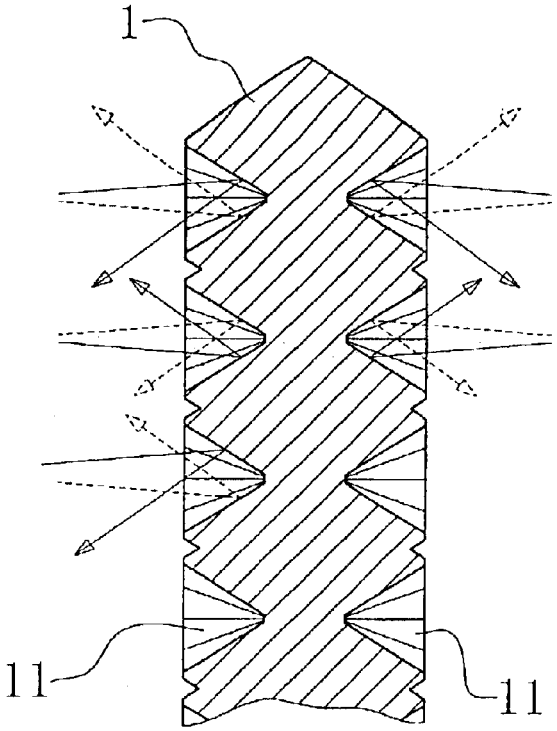
FIG. 2 is a schematic cross sectional view of an embodiment of the ornamental block provided with conical cavities in both surfaces in accordance with the present invention.
Figure 3:
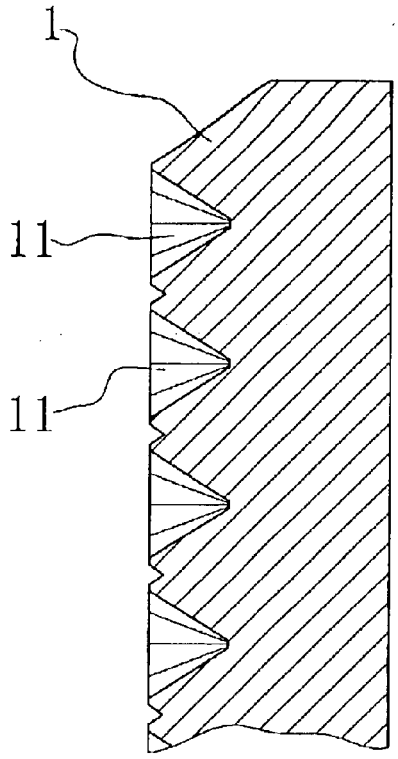
FIG. 3 is a cross sectional view of an embodiment of the ornamental block provided with conical cavities in single surface in accordance with the present invention.
Figure 4:
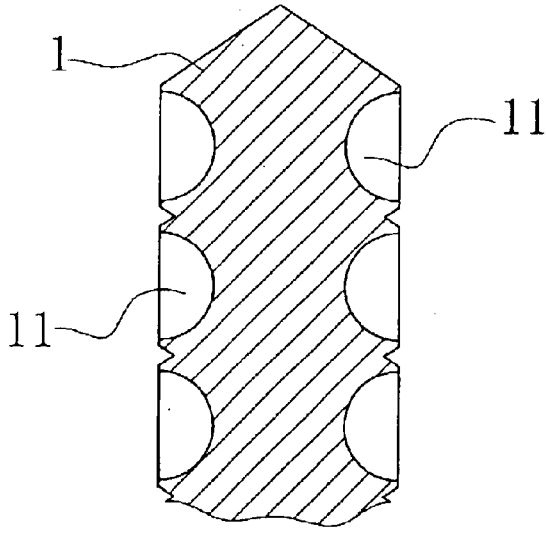
FIG. 4 is a cross sectional view of an embodiment of the ornamental block provided with semicircular cavities in both surfaces in accordance with the present invention.
Figure 5:
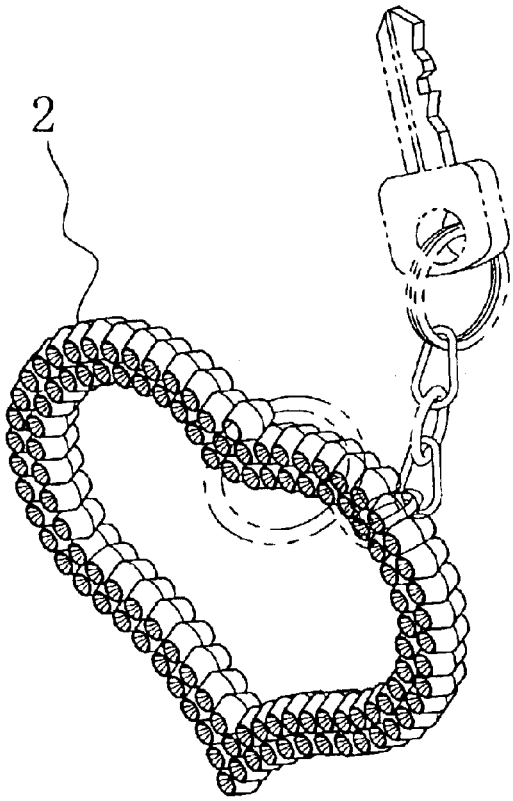
FIG. 5 is a perspective view of the key ring with another embodiment of the ornamental block in accordance with the present invention.
Figure 6:
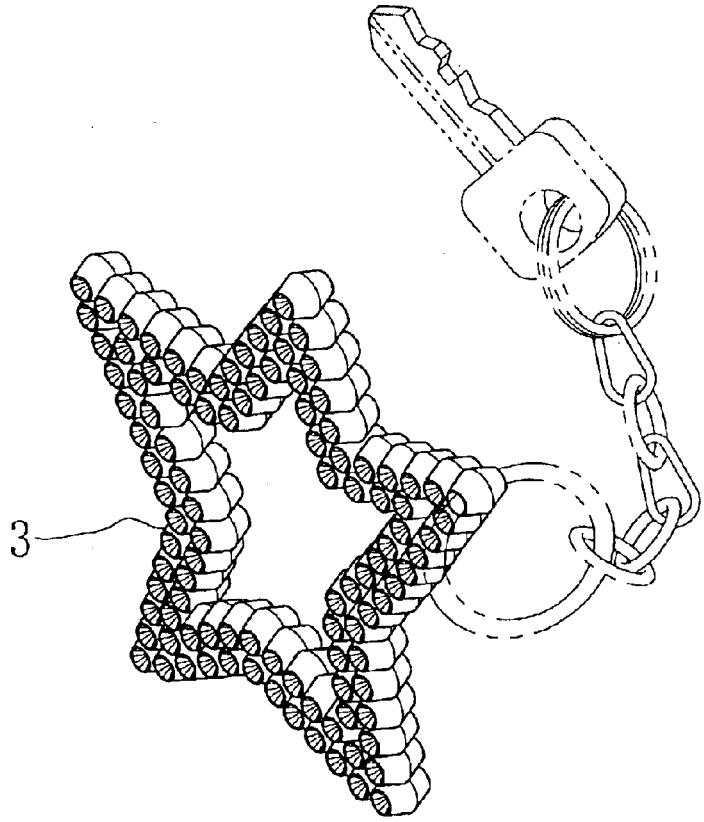
FIG. 6 is a perspective view of the key ring with yet another embodiment of the ornamental block in accordance with the present invention.
Figure 7:
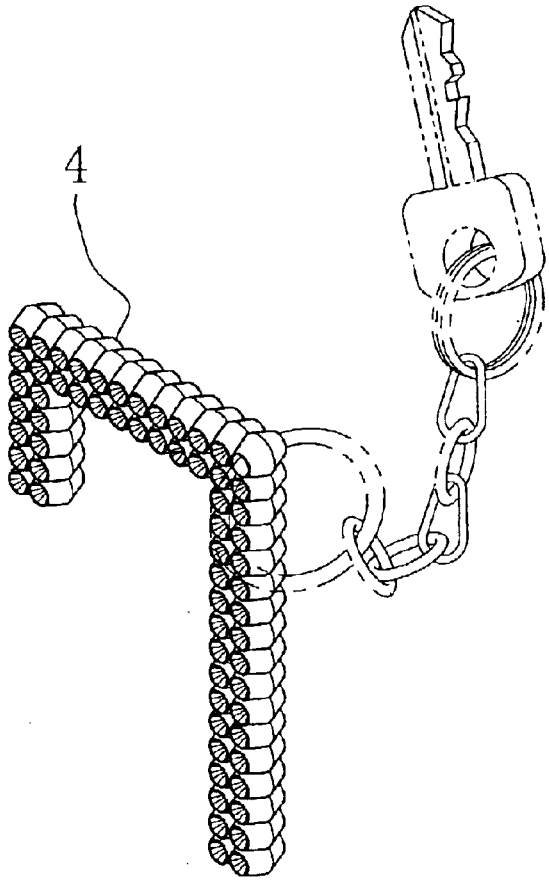
FIG. 7 is a perspective view of the key ring with a further embodiment of the ornamental block in accordance with the present invention; and, FIG. 8 is a perspective view of the key ring with still a further embodiment of the ornamental block in accordance with the present invention.
Figure 8:
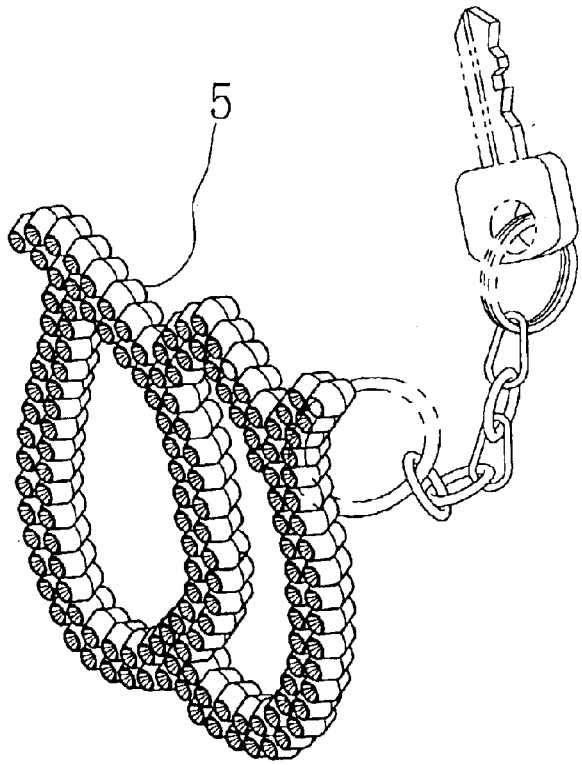

Referring to FIG. 1, a key ring in the present invention includes a one-piece ornamental block 1 and a buckle ring 12. The one-piece ornamental block 1 is made of plastic material. A plurality of spaced conical cavities 11 are disposed in the at least one surface of the ornamental block 1. Referring to FIGS. 2, 3 and 4, the shapes of the spaced cavities 11 may alternatively be semicircular, polygonal, etc. The inner surface of each cavity 11 is treated by vacuum gilding so as for the ornamental block 1 to achieve diamond-shining effect. A through hole is provided in one end of the ornamental block 1 for the buckle ring 12 to penetrate through.

The buckle ring 12 is provided to connect with a key 13 by one end and to penetrate through the through hole of the ornamental block 1 by the other end.

Referring to FIGS. 5, 6, 7 and 8, the ornamental block 1 may be any kind of configuration, such as, an English letter 1, a heart 2, a star 3, a figure 4, a flower 5.

While the preferred embodiments of the invention have been described above, it will be recognized and understood that various modifications may be made therein, and the appended claims are intended to cover all such modifications which may fall within the spirit and scope of the invention.

What is claimed is:

1. A key ring comprising:

an ornamental block formed of plastic material, a plurality of spaced cavities being disposed in at least one side of said ornamental block, an inner surface being defined about each said cavity, said inner surface of at least one said cavity including a gilded portion for generating a sparkling reflective effect, a through hole being provided adjacent one end of said ornamental block; and, a buckle ring for connection with a key, said buckle ring, engaging said through hole of said ornamental block.

2. A key ring as recited in claim 1, wherein the shape of each of said spaced cavities of said ornamental block is selected from the group consisting of: conical, semicircular, and polygonal shapes.

3. A key ring as recited in claim 1, wherein said ornamental block defines a configuration selected from the group consisting of: an English letter, a heart, a star, a figure, or a flower.

* * * * *